US008120254B2

(12) United States Patent
Aoto et al.

(10) Patent No.: US 8,120,254 B2
(45) Date of Patent: Feb. 21, 2012

(54) PLASMA DISPLAY PANEL COMPRISING SPUTTERING PREVENTION LAYER

(75) Inventors: Koji Aoto, Hyogo (JP); Keiji Horikawa, Osaka (JP); Kaname Mizokami, Kyoto (JP)

(73) Assignee: Panasonic Corporation, Osaka (JP)

( * ) Notice: Subject to any disclaimer, the term of this patent is extended or adjusted under 35 U.S.C. 154(b) by 202 days.

(21) Appl. No.: 12/519,241

(22) PCT Filed: Jan. 6, 2009

(86) PCT No.: PCT/JP2009/000005

§ 371 (c)(1), (2), (4) Date: Jun. 15, 2009

(87) PCT Pub. No.: WO2009/090855

PCT Pub. Date: Jul. 23, 2009

(65) Prior Publication Data

US 2010/0327741 A1 Dec. 30, 2010

(30) Foreign Application Priority Data

Jan. 15, 2008 (JP) ..... 2008-005341

(51) Int. Cl.
*H01J 17/49* (2006.01)

(52) U.S. Cl. ..... 313/587; 313/586; 313/584

(58) Field of Classification Search ..... 313/582–587
See application file for complete search history.

(56) References Cited

U.S. PATENT DOCUMENTS 5,917,284 A * 6/1999 Moore et al. ..... 313/586
7,786,957 B2 * 8/2010 Sakata ..... 345/67
2007/0096653 A1 5/2007 Jeong et al.
2007/0126361 A1 * 6/2007 Lee ..... 313/586
2007/0152593 A1 7/2007 Kim et al.
2007/0296336 A1 12/2007 Miyazaki et al.
2008/0024062 A1 * 1/2008 Kim et al. ..... 313/582

(Continued)

FOREIGN PATENT DOCUMENTS

EP 1 806 762 7/2007

(Continued)

OTHER PUBLICATIONS

International Search Report issued Feb. 10, 2009 in the International (PCT) Application No. PCT/JP2009/000005.

(Continued)

*Primary Examiner* — Nimeshkumar Patel
*Assistant Examiner* — Jose M Diaz
(74) *Attorney, Agent, or Firm* — Wenderoth, Lind & Ponack, L.L.P.

(57) ABSTRACT

A plasma display panel (PDP) includes a front panel (2) having a front glass substrate (3) on which display electrodes (6) are formed, a dielectric layer (8) covering the display electrodes (6), and a protective layer (9) formed on the dielectric layer (8). The PDP panel also includes a rear panel (10) facing the front panel (2) to form a discharge space therebetween, and including address electrodes formed along a direction intersecting with the display electrodes (6) and barrier ribs partitioning the discharge space. The protective layer (9) includes a primary film (91) made of MgO and formed on the dielectric layer (8), and aggregated particles (92) formed of several crystal particles of MgO aggregated together and at least one type of particles (93) made of non-organic material and different from aggregated particles (92). The particles (92) and (93) are distributed on the primary film (91).

9 Claims, 7 Drawing Sheets

U.S. PATENT DOCUMENTS

| | | | | |
|---|---|---|---|---|
| 2008/0049382 | A1* | 2/2008 | Kasahara | 361/600 |
| 2008/0157671 | A1* | 7/2008 | Naoi et al. | 313/586 |
| 2008/0157673 | A1* | 7/2008 | Fukui et al. | 313/587 |
| 2009/0140652 | A1 | 6/2009 | Fukui et al. | |
| 2010/0096986 | A1* | 4/2010 | Tsujita et al. | 313/582 |
| 2010/0102723 | A1 | 4/2010 | Mizokami et al. | |
| 2010/0213839 | A1* | 8/2010 | Yamaryo et al. | 313/587 |

FOREIGN PATENT DOCUMENTS

| | | |
|---|---|---|
| JP | 11-339665 | 12/1999 |
| JP | 2002-260535 | 9/2002 |
| JP | 2006-59779 | 3/2006 |
| JP | 2006-244784 | 9/2006 |
| JP | 2007-95436 | 4/2007 |
| JP | 2007-149384 | 6/2007 |
| JP | 2007-184264 | 7/2007 |
| KR | 10-2007-0047075 | 5/2007 |
| WO | 2007/139183 | 12/2007 |
| WO | 2009/066424 | 5/2009 |

OTHER PUBLICATIONS

Supplementary European Search Report issued Feb. 8, 2011 in Application No. EP 09 70 0038.

* cited by examiner

PLASMA DISPLAY PANEL COMPRISING SPUTTERING PREVENTION LAYER

This application is a U.S. National Phase Application of PCT International Application PCT/JP2009/000005

TECHNICAL FIELD

The present invention relates to plasma display panels to be used in display devices.

BACKGROUND ART

A plasma display panel (hereinafter referred to simply as a PDP) allows achieving a high definition display and a large-size screen, so that television receivers (TV) with a large screen having as large as 65 inches diagonal length can be commercialized by using the PDP. In recent years, use of the PDP in high-definition TVs, which need more than doubled scanning lines than conventional NTSC method, has progressed and the PDP free from lead (Pb) has been required in order to contribute to environment protection.

The PDP is basically formed of a front panel and a rear panel. The front panel comprises the following elements:

- a glass substrate made of sodium-borosilicate-based float glass;
- display electrodes, formed of striped transparent electrodes and bus electrodes, formed on a principal surface of the glass substrate,
- a dielectric layer covering the display electrodes and working as a capacitor; and
- a protective layer made of magnesium oxide (MgO) and formed on the dielectric layer.

The rear panel comprises the following elements:

- a glass substrate;
- striped address electrodes formed on a principal surface of the glass substrate,
- a primary dielectric layer covering the address electrodes;
- barrier ribs formed on the primary dielectric layer; and
- phosphor layers formed between the respective barrier ribs and emitting light in red, green, and blue respectively.

The front panel confronts the rear panel such that its surface mounted with the electrodes faces a surface mounted with the electrodes of the rear panel, and peripheries of both the panels are sealed in an airtight manner to form a discharge space therebetween, and the discharge space is partitioned by the barrier ribs. The discharge space is filled with discharge gas of Ne and Xe at a pressure ranging from 400 Torr to 600 Torr. The PDP allows displaying a color video through this method: Voltages of video signals are selectively applied to the display electrodes for discharging, thereby producing ultra-violet rays, which excite the respective phosphor layers, so that colors in red, green, and blue are emitted, thereby achieving the display of a color video.

The protective layer formed on the dielectric layer of the front panel of the foregoing PDP protects the dielectric layer from ion impact caused by the discharge, and emits primary electrons for generating address discharges. The protection of the dielectric layer from the ion impact plays an important role for preventing a discharge voltage from rising, and the emission of primary electrons for generating the address discharges also plays an important role for eliminating a miss in the address discharges because the miss causes flickers on videos.

To reduce the flickers on videos, the number of primary electrons emitted from the protective layer should be increased. For this purpose, impurities are added to MgO or particles of MgO are formed on the protective layer made of MgO. These instances are disclosed in, e.g. Patent Documents 1, 2, 3.

In recent years, the number of high-definition TV receivers has increased, which requires the PDP to be manufactured at a lower cost, to consume a lower power, and to be a full HD (high-definition, 1920×1080 pixels, and progressive display) with a higher brightness. The characteristics of emitting electrons from the protective layer determine the picture quality, so that it is vital for controlling the electron emission characteristics.

A protective layer with a mixture of impurities has been tested whether or not it can improve the electron-emission characteristics; however, when the characteristics can be improved, electric charges are stored on the surface of the protective layer. If the stored electric charges are used as a memory function, the number of electric charges decreases greatly with time, i.e. an attenuation rate becomes greater. To overcome this greater attenuation rate, a measure is needed such as increment in an applied voltage. The protective layer thus should have two contradictory characteristics, i.e. one is a high emission of electrons, and the other one is a smaller attenuation rate for a memory function, namely, a high retention of electric charges.

MgO particles are formed on he protective layer made of MgO for satisfying the foregoing characteristics contradictory to each other. If no MgO particles are available on the protective layer, needle crystals of the protective layer material are grown uniformly in discharge cells by a discharge, and the needle crystals can prevent the protective layer from being dug by sputtering. However, the formation of MgO particles on the protective layer made of MgO has the needle crystals grow selectively on MgO particles, so that the sputtering to a region, having no needle crystals, of the protective layer is promoted, and the service life of the PDP is thus obliged to be shortened.

Patent Document 1: Unexamined Japanese Patent Application Publication No. 2002-260535

Patent Document 2: Unexamined Japanese Patent Application Publication No. H11-339665

Patent Document 3: Unexamined Japanese Patent Application Publication No. 2006-59779

DISCLOSURE OF INVENTION

The PDP of the present invention comprises the following structural elements:

- a front panel including a substrate on which display electrodes are formed, a dielectric layer covering the display electrodes, and a protective layer formed on the dielectric layer; and
- a rear panel opposing to the front panel to form a discharge space therebetween, and including address electrodes formed along the direction intersecting with the display electrodes and barrier ribs for partitioning the discharge space.

The protective layer includes a primary film made of metal oxide and formed on the dielectric layer, and a first particle formed of several crystal particles aggregated together and made of metal oxide, and at least one type of second particle different from the first particle, where the first particle and the second particle are dispersed on the primary film.

The structure discussed above allows providing a long life PDP that can improve the electron emission characteristics of the PDP, and yet the PDP has electric charge retention characteristics, and features quality picture, low cost, and low voltage, and also prevents the primary film from being dug by sputtering.

DESCRIPTION OF REFERENCE MARKS

Figure 1:
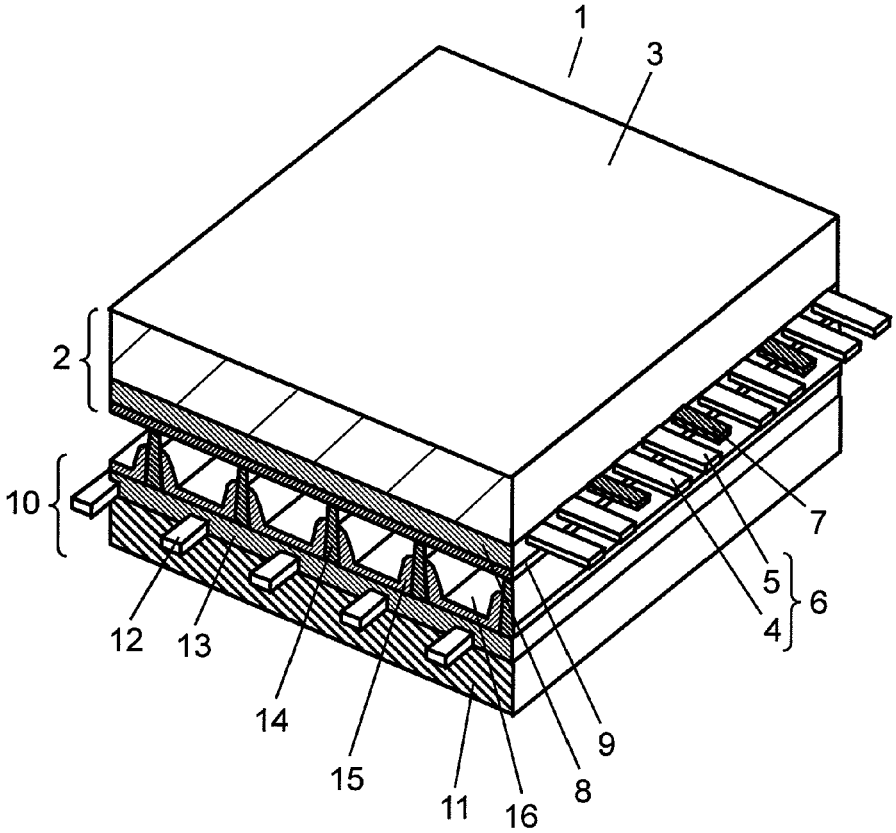
FIG. 1 shows a perspective view illustrating a structure of a PDP in accordance with an embodiment of the present invention.

1 PDP
2 front panel
3 front glass substrate
4 scan electrode
4*a*, 5*a* transparent electrode
4*b*, 5*b* metal bus electrode
5 sustain electrode
6 display electrode
7 black stripe (light proof layer)
8 dielectric layer
9 protective layer
10 rear panel
11 rear glass substrate
12 address electrode
13 primary dielectric layer
14 barrier rib
15 phosphor layer
16 discharge space
81 first dielectric layer
82 second dielectric layer
91 primary film
92 aggregate particles
92*a* crystal particle
93 particles of non-organic material
95, 97 needle crystal
96 dug section

DESCRIPTION OF PREFERRED EMBODIMENT

An exemplary embodiment of the present invention is demonstrated hereinafter with reference to the accompanying drawings.

Exemplary Embodiment

FIG. 1 shows a perspective view illustrating a structure of the PDP in accordance with an the embodiment of the present invention. The PDP is basically structured similarly to a PDP of AC surface discharge type generally used. As shown in FIG. 1, PDP 1 is formed of front panel 2, which includes front glass substrate 3, and rear panel 10, which includes rear glass substrate 11. Front panel 2 and rear panel 10 confront each other and the peripheries thereof are sealed in an airtight manner with sealing agent such as glass frit, thereby forming discharge space 16, which is filled with discharge gas of Ne and Xe at a pressure falling within a range between 400 Torr and 600 Torr.

Multiple pairs of belt-like display electrodes 6 formed of scan electrode 4 and sustain electrode 5 are placed in parallel with multiple black stripes (lightproof layer) 7 on front glass substrate 3 of front panel 2. Dielectric layer 8 working as a capacitor is formed on front glass substrate 3 such that layer 8 can cover display electrodes 6 and lightproof layers 7. On top of that, protective layer 9 made of magnesium oxide (MgO) is formed on the surface of dielectric layer 8.

Multiple belt-like address electrodes 12 are placed in parallel with one another on rear glass substrate 11 of rear panel 10, and they are placed along a direction intersecting at right angles with scan electrodes 4 and sustain electrodes 5 formed on front panel 2. Primary dielectric layer 13 covers those address electrodes 12. Barrier ribs 14 having a given height are formed on primary dielectric layer 13 placed between respective address electrodes 12, and barrier ribs 14 partition discharge space 16. Phosphor layers 15 are applied, in response to respective address electrodes 12, onto grooves formed between each one of barrier ribs 14. Phosphor layers 15 emit light in red, blue, and green with an ultraviolet ray respectively. A discharge cell is formed at a junction point where scan electrode 14, sustain electrode 15 and address electrode 12 intersect with each other. The discharge cells having phosphor layers 15 of red, blue, and green respectively are placed along display electrodes 6, and these cells work as pixels for color display.

Figure 2:
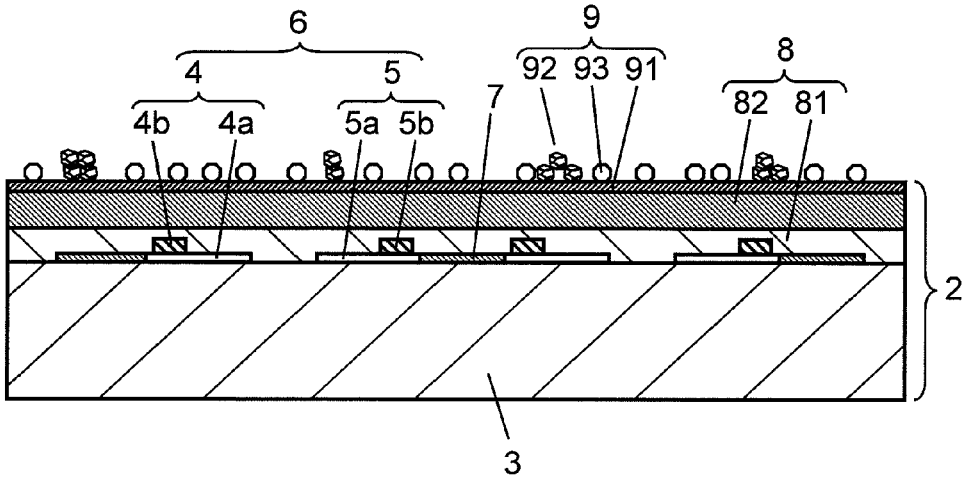
FIG. 2 shows a sectional view illustrating a structure of a front panel of the PDP.

FIG. 2 shows a sectional view illustrating a structure of front panel 2 of the PDP in accordance with this embodiment. FIG. 2 shows front panel 2 upside down from that shown in FIG. 1. As shown in FIG. 2, display electrode 6 formed of scan electrode 4 and sustain electrode 5 is patterned on front glass substrate 3 manufactured by the float method. Lightproof layer 7 is also patterned together with display electrode 6 on substrate 3. Scan electrode 4 and sustain electrode 5 are respectively formed of transparent electrodes 4*a*, 5*a* made of indium tin oxide (ITO) or tin oxide ($SnO_2$), and metal bus electrodes 4*b*, 5*b* formed on electrodes 4*a*, 5*a*. Metal bus electrodes 4*b*, 5*b* give electrical conductivity to transparent electrodes 4*a*, 5*a* along the longitudinal direction of electrodes 4*a*, 5*a*, and they are made of conductive material of which chief ingredient is silver (Ag).

Dielectric layer 8 is formed of at least two layers, i.e. first dielectric layer 81 that covers transparent electrodes 4*a*, 5*a* and metal bus electrodes 4*b*, 5*b* and light proof layer 7 formed on front glass substrate 3, and second dielectric layer 82 formed on first dielectric layer 81. Protective layer 9 is formed on second dielectric layer 82.

Next, a method of manufacturing the PDP is demonstrated hereinafter. First, form scan electrodes 4, sustain electrodes 5, and lightproof layer 7 on front glass substrate 3. Scan electrode 4 and sustain electrode 5 are respectively formed of transparent electrodes 4*a*, 5*a* and metal bus electrodes 4*b*, 5*b*. These transparent electrodes 4*a*, 5*a*, and metal bus electrodes 4*b*, 5*b* are patterned with a photo-lithography method. Transparent electrodes 4*a*, 5*a* are formed by using a thin-film process, and metal bus electrodes 4*b*, 5*b* are made by firing the paste containing silver (Ag) at a given temperature before the paste is hardened. Light proof layer 7 is made by screen-printing the paste containing black pigment, or by forming the black pigment on the entire surface of the glass substrate, and then patterning the pigment with the photolithography method before the paste is fired.

Next, apply dielectric paste onto front glass substrate 3 with a die-coating method such that the paste can cover scan electrodes 4, sustain electrodes 5, and lightproof layer 7, thereby forming a dielectric paste layer (dielectric material layer). Then leave front glass substrate 3, on which dielectric paste is applied, for a given time as it is, so that the surface of the dielectric paste is leveled to be flat. Then fire and harden the dielectric paste layer for forming dielectric layer 8 which covers scan electrodes 4, sustain electrodes 5 and lightproof layer 7. The dielectric paste is a kind of paint containing binder, solvent, and dielectric material such as glass powder. Next, form protective layer 9 made of magnesium oxide (MgO) on dielectric layer 8 with a vacuum deposition method. The foregoing steps allow forming a predetermined structural elements (scan electrodes 4, sustain electrodes 5, lightproof layer 7, dielectric layer 8 and protective layer 9) on front glass substrate 3, so that front panel 2 is completed. Protective layer 9 will be detailed later.

Rear panel 10 is formed this way: First, form a material layer, which is a structural element of address electrode 12, by screen-printing the paste containing silver (Ag) onto rear glass substrate 11, or by patterning with the photolithography method a metal film which is formed in advance on the entire surface of substrate 11. Then fire the material layer at a given temperature, thereby forming address electrode 12. Next, form a dielectric paste layer on rear glass substrate 11, on which address electrodes 12 are formed, by applying dielectric paste onto substrate 11 with the die-coating method such that the layer can cover address electrodes 12. Then fire the dielectric paste layer for forming primary dielectric layer 13. The dielectric paste is a kind of paint containing binder, solvent, and dielectric material such as glass powder.

Next, apply the paste containing the material for barrier rib onto primary dielectric layer 13, and pattern the paste into a given shape, thereby forming a barrier-rib layer. Then fire this barrier-rib layer for forming barrier ribs 14. The photolithography method or a sand-blasting method can be used for patterning the paste applied onto primary dielectric layer 13. Next, apply the phosphor paste containing phosphor material onto primary dielectric layer 13 surrounded by barrier ribs 14 adjacent to each other and also onto lateral walls of barrier ribs 14. Then fire the phosphor paste for forming phosphor layer 15. The foregoing steps allow completing rear panel 10 including the predetermined structural elements on rear glass substrate 11.

Front panel 2 and rear panel 10 discussed above are placed confronting each other such that scan electrodes 4 intersect with address electrodes 12 at right angles, and the peripheries of panel 2 and panel 10 are sealed with glass frit to form discharge space 16 therebetween, which is filled with discharge gas including Ne, Xe. PDP 1 is thus completed.

First dielectric layer 81 and second dielectric layer 82 forming dielectric layer 8 of front panel 2 are detailed hereinafter. The dielectric material of first dielectric layer 81 is formed of the following compositions: bismuth oxide ($Bi_2O_3$) in 20-40 wt %; at least one composition in 0.5-12 wt % selected from the group consisting of calcium oxide (CaO), strontium oxide (SrO), and barium oxide (BaO); and at least one composition in 0.1-7 wt % selected from the group consisting of molybdenum oxide ($MoO_3$), tungstic oxide ($WO_3$), cerium oxide ($CeO_2$), and manganese dioxide ($MnO_2$).

At least one composition in 0.1-7 wt % selected from the group consisting of copper oxide (CuO), chromium oxide ($Cr_2O_3$), cobalt oxide ($Co_2O_3$), vanadium oxide ($V_2O_7$), and antimony oxide ($Sb_2O_3$) can replace the foregoing molybdenum oxide ($MoO_3$), tungstic oxide ($WO_3$), and cerium oxide ($CeO_2$), manganese dioxide ($MnO_2$).

Other than the foregoing compositions, the following compositions free from lead (Pb) can be contained with no specification about their content, i.e. within the content range of prior art: zinc oxide (ZnO) in 0-40 wt %; boron oxide ($B_2O_3$) in 0-35 wt %; silicon dioxide ($SiO_2$) in 0-15 wt %, and aluminum oxide ($Al_2O_3$) in 0-10 wt %.

The dielectric material containing the foregoing compositions is grinded by a wet jet mill or a ball mill into powder of which average particle diameter is 0.5 μm-2.5 μm. Next, this dielectric powder in 55-70 wt % and binder component in 30-45 wt % are mixed with a three-roll mill, so that the paste for the first dielectric layer to be used in the die-coating or the printing can be produced.

The binder component is formed of terpinol or butyl carbitol acetate which contains ethyl-cellulose or acrylic resin in 1 wt %-20 wt %. The paste can contain, upon necessity, plasticizer such as dioctyl phthalate, dibutyl phthalate, triphenyl phosphate, tributyl phosphate, and dispersant such as glycerop mono-oleate, sorbitan sesquio-leate, alkyl-allyl based phosphate for improving the printing performance.

Next, the paste for the first dielectric layer discussed above is applied to front glass substrate 3 with the die-coating method or the screen-printing method such that the paste covers display electrodes 6, before the paste is dried. The paste is then fired at 575-590° C. a little bit higher than the softening point of the dielectric material.

Second dielectric layer 82 is detailed hereinafter. The dielectric material of second dielectric layer 82 is formed of the following compositions: bismuth oxide ($Bi_2O_3$) in 11-20 wt %; at least one composition in 1.6-21 wt % selected from the group consisting of calcium oxide (CaO), strontium oxide (SrO), and barium oxide (BaO); and at least one composition in 0.1-7 wt % selected from the group consisting of molybdenum oxide ($MoO_3$), tungstic oxide ($WO_3$), and cerium oxide ($CeO_2$).

At least one composition in 0.1-7 wt % selected from the group consisting of copper oxide (CuO), chromium oxide ($Cr_2O_3$), cobalt oxide ($Co_2O_3$), vanadium oxide ($V_2O_7$), antimony oxide ($Sb_2O_3$), and manganese dioxide ($MnO_2$) can replace the foregoing molybdenum oxide ($MoO_3$), tungstic oxide ($WO_3$), and cerium oxide ($CeO_2$).

Other than the foregoing compositions, the following compositions free from lead (Pb) can be contained with no specification about their content, i.e. within the content range of prior art: zinc oxide (ZnO) in 0-40 wt %; boron oxide ($B_2O_3$) in 0-35 wt %; silicon dioxide ($SiO_2$) in 0-15 wt %, and aluminum oxide ($Al_2O_3$) in 0-10 wt %.

The dielectric material containing the foregoing compositions is grinded by the wet jet mill or the ball mill into powder of which average particle diameter is 0.5 μm-2.5 μm. Next, this dielectric powder in 55-70 wt % and binder component in 30-45 wt % are mixed with a three-roll mill, so that the paste for the second dielectric layer to be used in the die-coating or the printing can be produced. The binder component is formed of terpinol or butyl carbitol acetate which contains ethyl-cellulose or acrylic resin in 1 wt %-20 wt %. The paste can contain, upon necessity, plasticizer such as dioctyl phthalate, dibutyl phthalate, triphenyl phosphate, tributyl phosphate, and dispersant such as glycerop mono-oleate, sorbitan sesquio-leate, alkyl-allyl based phosphate for improving the printing performance.

Then the paste of the second dielectric layer discussed above is applied onto first dielectric layer 81 with the die-coating method or the screen-printing method before the paste is dried. The paste is then fired at 550-590° C. a little bit higher than the softening point of the dielectric material.

The film thickness of dielectric layer 8 (total thickness of first layer 81 and second layer 82) is preferably not greater than 41 μm in order to secure the visible light transmission. First dielectric layer 81 contains a greater amount (20-40 wt %) of bismuth oxide ($Bi_2O_3$) than second dielectric layer 82 does in order to suppress the reaction between metal bus electrodes 4*b*, 5*b* with silver (Ag), so that first layer 81 is obliged to have a visible light transmittance lower than that of second layer 82. To overcome this problem, first layer 81 is formed thinner than second layer 82.

If second dielectric layer 82 contains bismuth oxide ($Bi_2O_3$) not greater than 11 wt %, it resists to be colored; however, air bubbles tend to occur in second layer 82, so that the content of not greater than 11 wt % is not desirable. On the other hand, if the content exceeds 40 wt %, second layer 82 tends to be colored, so that it is not favorable for increasing the visible light transmittance.

A brightness of PDP advantageously increases and a discharge voltage also advantageously lowers at a thinner film thickness of dielectric layer 8, so that the film thickness is desirably set as thin as possible insofar as the dielectric voltage is not lowered. Considering these conditions, the film thickness of dielectric layer 8 is set not greater than 41 μm in this embodiment. To be more specific, first dielectric layer 81 has a thickness of 5-15 μm and second dielectric layer 82 has a thickness of 20-36 μm.

The PDP thus manufactured encounters only little coloring (yellowing) in front glass substrate 3 although display electrodes 6 are formed of silver (Ag), and yet, its dielectric layer 8 has no air bubbles, so that dielectric layer 8 excellent in dielectric voltage is achievable.

Figure 3:
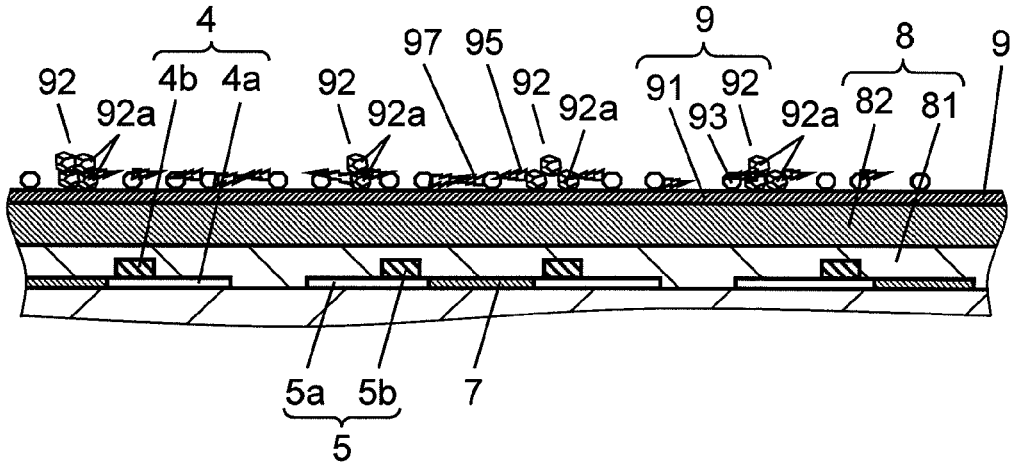
FIG. 3 shows a sectional view enlarging a protective layer of the PDP.

Protective layer 9, a feature of PDP 1 of the present invention, is detailed hereinafter. FIG. 3 enlarges protective layer 9 of PDP 1 in accordance with this embodiment. As shown in FIG. 3, protective layer 9 is formed this way: primary film 91 made of MgO is formed in the thickness of 700-800 nm on dielectric layer 8, and aggregated particles 92 are dispersed uniformly and discretely on the entire surface of this primary film 91. Aggregated particle (first particle) 92 is formed by aggregating several particles of crystal particles 92*a* made of metal oxide, i.e. MgO. Among aggregated particles 92 formed on primary film 91, particles 93 (second particle) made of non-organic material are dispersed on the entire surface uniformly and discretely.

Figure 4:
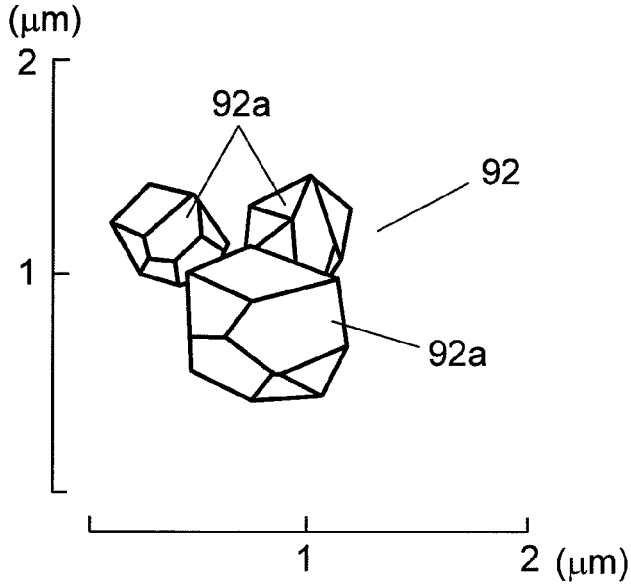
FIG. 4 shows an enlargement for the description purpose of aggregated particles existing in the protective layer of the PDP.

As shown in FIG. 4, aggregated particle 92 is formed by aggregating or necking crystal particles 92*a*, i.e. primary particles having a given size, and particles 92*a* are not bonded with great bonding force together like a solid body, but the multiple primary particles simply form an aggregate with static electricity or van der Waals force. Thus parts of or all of the aggregated particle 92 are gathered one another as weak as they turned into primary particles by external stimulus such as an ultrasonic wave, thereby bonding together to form the aggregated particle 92. The particle diameter of aggregated particle 92 is approx. 1 μm, and crystal particle 92*a* desirably forms a polyhedral shape having seven faces or more than seven faces such as 14 faces or 12 faces.

The particle diameter of the primary particle, i.e. crystal particle 92*a*, can be controlled depending on a production condition of crystal particles 92*a*. For instance, when crystal particles 92*a* are formed by firing the precursor of MgO such as magnesium carbonate or magnesium hydroxide, the firing temperature or the firing atmosphere is controlled, whereby the particle diameter can be controlled. In general, the firing temperature can be selected from the range of 700-1500° C. A rather higher firing temperature over 1000° C. allows the diameter of the primary particle to fall within the range of 0.3-2 μm. Crystal particle 92*a* can be obtained by heating the precursor of MgO, during its production steps, multiple primary particles are bonded by the phenomenon called necking or aggregated together, whereby aggregated particle 92 can be obtained.

Particles 93, i.e. second particle made of non-organic material, are fine particles formed of light transmissible fine particles of metal oxide, to be more specific, the metal oxide includes, for instance, zinc oxide (ZnO), silicon dioxide ($SiO_2$), aluminum oxide ($Al_2O_3$), or mixture of the foregoing metal oxides. Differing from aggregated particles 92, particles 93 are not necessarily formed by aggregating primary particles, but they are desirably dispersed on primary film 91 uniformly and independently. The diameter of particle 93 is desirably equal to or smaller than that of particle 92, and the average diameter preferably ranges between approx. 1-2 μm.

Aggregated particles 92 and particles 93 of non-organic material are dispersed on primary film 91 this way: disperse these particles into organic solvent, and then apply the solvent onto primary film 91, or spray these particles directly onto primary film 91.

The following experiment is done for confirming an advantage of protective layer 9 in accordance with this embodiment: the first particles, i.e. aggregated particles 92, and the second particles, i.e. particles 93 of non-organic material, are dispersed on primary film 91. Several units of PDP 1 are produced, in which the ratio of area covered with these particles vs. the entire area of film 91 are changed. Then examine respective PDPs about the electron emission characteristics, electric charge retention characteristics, and a dug amount in primary film 91 after a discharge in a given time.

The electron emission characteristics are expressed in number, i.e. a greater number shows a greater amount of electrons emitted, and shows an amount of primary electrons emitted, which is determined by the surface status of discharge, a kind of gas, and a status of the gas. The amount of emitted primary electrons is measured this way: irradiate the surface with an electron beam, and measure a current of electrons emitted from the surface. However, it is difficult to evaluate the surface of front panel 2 with non-destructive examination.

The evaluation method disclosed in Unexamined Japanese Patent Application Publication No. 2007-48733 is thus employed in this embodiment, namely, a statistical delay time, which is a reference to the easiness of discharge occurrence, among delay times in discharge is measured. This reference number is inversed, and then integrated, thereby obtaining a value which linearly corresponds to the amount of emitted primary electrons, so that the value is used for the evaluation. The delay time in discharge expresses the time of discharge delay (hereinafter referred to as "ts") from the pulse rising, and the discharge delay is chiefly caused by a struggle for the primary electrons, which trigger the discharge, to emit from the surface of protective layer 9 into the air.

The electric charge retention characteristics are expressed with a voltage value applied to scan electrodes 4 (hereinafter referred to as a Vscn lighting voltage), to be more specific, electric charge retention capability can be increased at a lower Vscn lighting voltage, so that PDP 1 can be driven at a low voltage design-wise. As a result, the power supply and electric components with a smaller withstanding voltage and a smaller capacity can be employed. In the existing products, semiconductor switching elements such as MOSFET are used for applying sequentially a scan voltage, and these switching elements have approx. 150V as a withstanding voltage. The Vscn lighting voltage is thus preferably lowered to not greater than 120V in the environment of 70° C. considering some change due to a temperature.

A dug amount of primary film 91 after the discharge in a given time is expressed in a dug depth measured on a sectional SEM photo of film 91. Before measuring the dug depth, PDP 1 has undergone an accelerated life test, i.e. apply sustain pulses at a cycle 8 times faster than a regular cycle to PDP 1 for discharge, and PDP 1 is destructed after the time corresponding 20,000 hours has passed.

Figure 5:
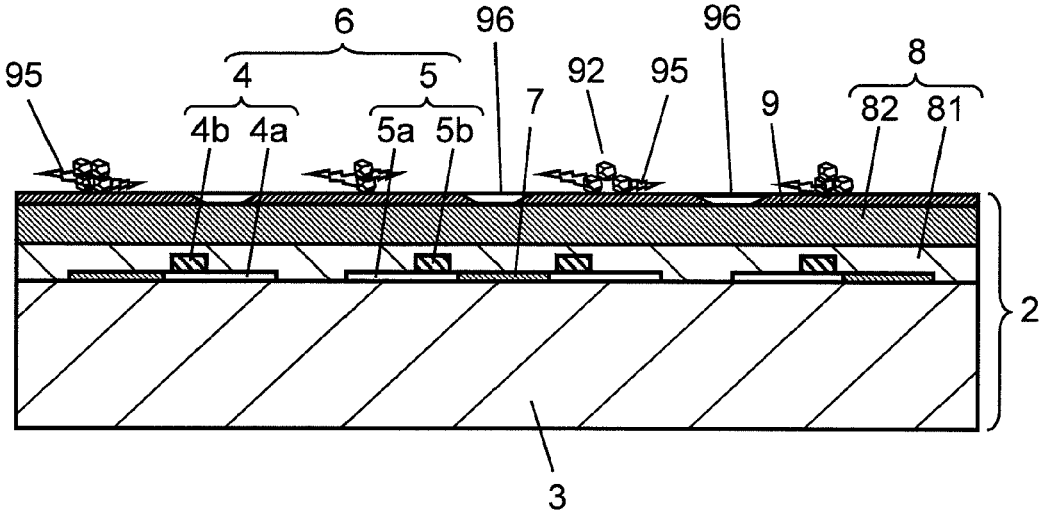
FIG. 5 shows a sectional view of a front panel of the PDP, of which primary film has only aggregated particles formed thereon in order to improve both of the electron emission characteristics and the electric charge retention characteristics.

FIG. 5 shows a sectional view of front panel 2 of PDP 1, of which primary film 91 has only aggregated particles 92 formed thereon in order to improve both of the electron emission characteristics and the electric charge retention characteristics. FIG. 5 shows the status after PDP 1 has undergone the accelerated life test corresponding to 20,000 hours.

In the case of protective layer 9 is formed of only primary film 91, namely, no aggregated particles are available, the discharge of PDP 1 sputters (digs) primary film 91, so that needle crystal formed of the component of film 91 grows on the surface of film 91 at the area of discharge cells, and the needle crystal covers film 91 in due course. The needle crystal highly resists to the sputtering (i.e. resists to being dug), so that it prevents primary film 91 from being further dug. As a result, primary film 91 as a whole improves its resistance to being dug.

On the other hand, in the case of forming aggregated particles 92 on primary film 91 as shown in FIG. 5, the sputtering onto film 91 allows needle crystal 95 to grow selectively on the surface of aggregated particles 92. As a result, film 91 is selectively sputtered only at an area not covered with needle crystal 95, so that dug sections 96 are formed on film 91. Further development of dug sections 96 invites a sharp rise in a discharge voltage, and eventually PDP 1 cannot discharge any more, i.e. ends its service life. To control the sputtering onto primary film 91 is thus vital for the PDP to increase the service life.

As shown in FIG. 3, PDP 1 in accordance with this embodiment includes protective layer 9 which satisfies both of the electron emission characteristics and the electric charge retention characteristics. This protective layer 9 is formed of the following structural elements:

- primary film 91 made of MgO and formed on dielectric layer 8;
- aggregated particles 92 formed by aggregating several crystal particles 92*a* made of MgO and distributed on primary film 91; and
- particles 93 made of non-organic material and distributed on primary film 91 for increasing the resistance to the sputtering, i.e. resistance to being dug.

The distribution of particles 93 made of non-organic material on primary film 91 allows needle crystal 97 to grow on the surface of particles 93. Needle crystal 97 is made of the component of film 91, which component is sputtered by the discharge onto film 91. In other words, needle crystal 95 has been formed on the surface of aggregated particle 92, and the same needle crystal 97 as crystal 95 is formed on the surface of particle 93. These needle crystals 95 and 97 highly resistive to the sputtering eventually cover primary film 91, which thus becomes resistive to the sputtering. As a result, the service life of PDP 1 can be prolonged.

Figure 6:
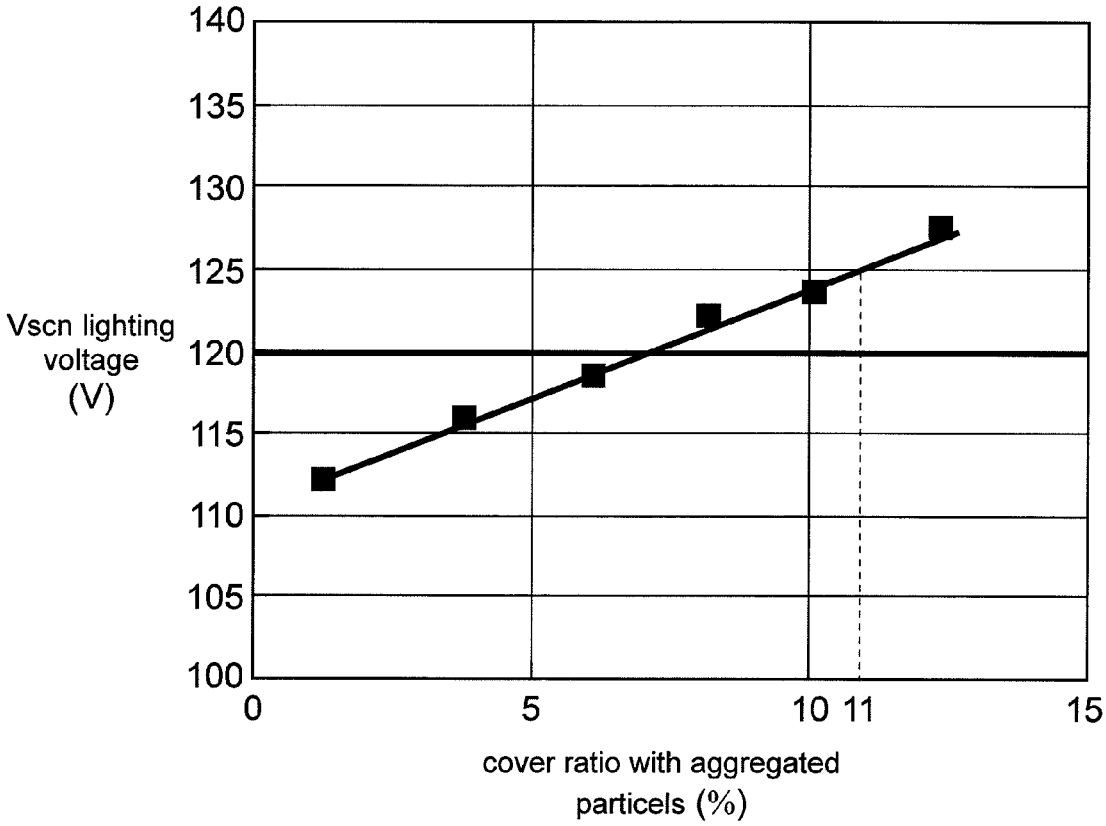
FIG. 6 shows characteristics of a "Vscn" lighting voltage as the electric charge retention characteristics in the case of varying a cover ratio of the aggregated particles vs. the primary film area under the condition that only the aggregated particles are dispersed on the primary film of the PDP.

FIG. 6 shows characteristics of a Vscn lighting voltage as the electric charge retention characteristics in the case of varying a cover ratio of the aggregated particles vs. the primary film area under the condition that only the aggregated particles are distributed on the primary film of the PDP. The cover ratio is a percentage of the area (numerator) on which the aggregated particles distributed on primary film 91 is projected vs. the area of primary film 91 (denominator). As discussed previously, the electric charge retention characteristics employ, as its indicator, a voltage applied to scan electrodes 4 (hereinafter referred to as a Vscn lighting voltage, which is needed to suppress electron emission in PDP 1). As shown in FIG. 6, Vscn lighting voltage increases at a greater cover ratio of aggregated particles 92 formed of crystal particles, i.e. first particles made of MgO. To be more specific, increasing the cover ratio with aggregated particles 92 will raise the Vscn lighting voltage to be applied to scan electrodes 4 and to be needed for suppressing the electron emission.

Figure 7:
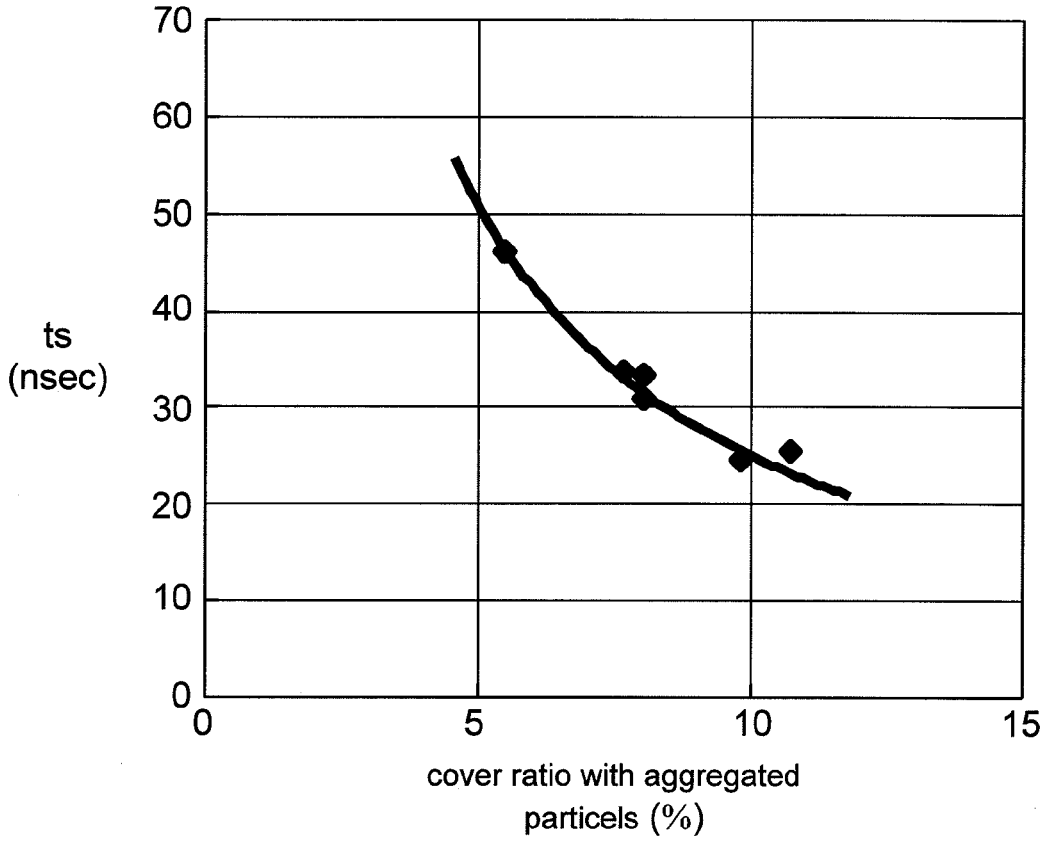
FIG. 7 shows the characteristics of discharge delay (=ts) as the electron emission characteristics in the case of varying a cover ratio of the aggregated particles vs. the primary film area under the condition that only the aggregated particles are dispersed on the primary film of the PDP.

FIG. 7 shows the characteristics of discharge delay (=ts) as the electron emission characteristics in the case of varying the cover ratio of aggregated particles 92 vs. the primary film area under the condition that only the aggregated particles are distributed on primary film 91. As shown in FIG. 7, the discharge delay becomes smaller at a greater cover ratio, i.e. the area of aggregated particles 92, i.e. the first particles, vs. the area of film 91. In this embodiment, the cover ratio with particles 92 ranges from 5% to 11%, and the discharge delay is set at not greater than 50 nsec, Vscn lighting voltage is set at not greater than 125V, based on the result obtained from FIGS. 6 and 7.

On the other hand, a greater cover ratio with particles 92 will increase a cover ratio with needle crystal 95, so that primary film 91 resultantly increases its resistance to the sputtering. However, as shown in FIG. 6, the Vscn lighting voltage also increases. To overcome this problem, the embodiment distributes particles 93 made of non-organic material among aggregated particles 92 as shown in FIG. 3, thereby increasing the cover ratio as a whole.

Figure 8:
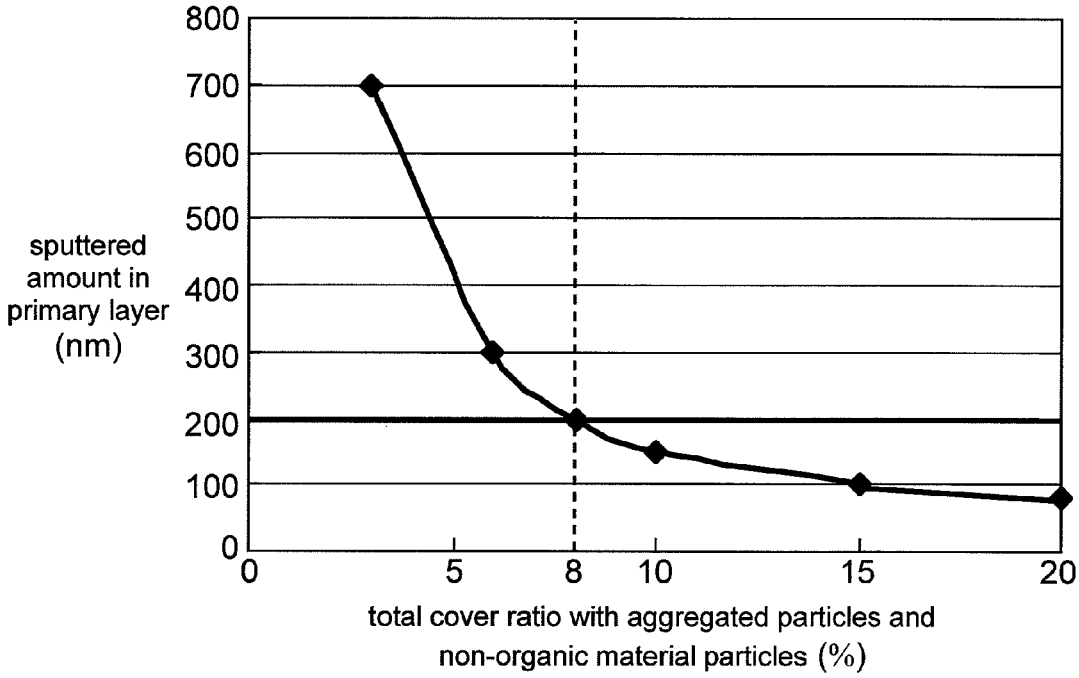
FIG. 8 shows the variation in sputtered amount in the case of varying a cover ratio of the aggregated particles and the particles of non-organic material vs. the primary film area under the condition that both of the foregoing particles are dispersed on the primary film of the PDP.
Figure 9:
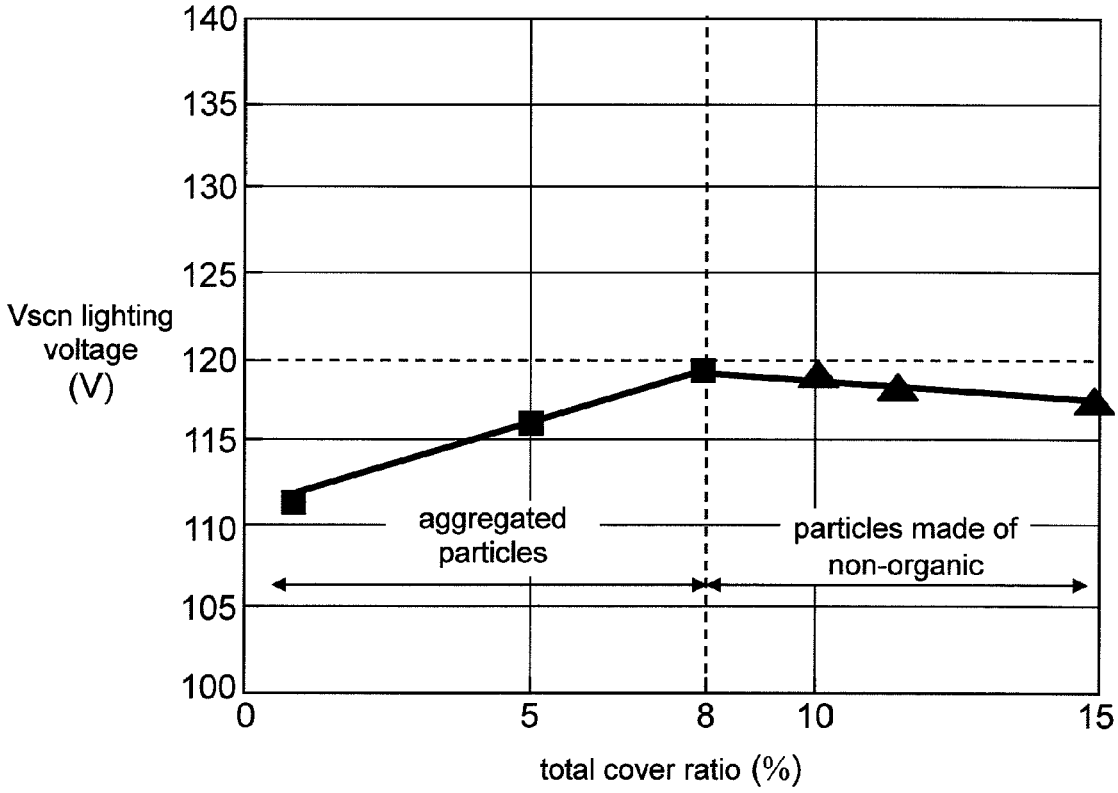
FIG. 9 shows the variation in the "Vscn" lighting voltage in the case of using the aggregated particles for covering the primary film up to the cover ratio of 8%, and then using the particles of non-organic material thereafter for increasing the cover ratio.

FIG. 8 shows the variation in sputtered amount (dug amount) in the case of varying the cover ratio of aggregated particles 92 and particles 93 made of non-organic material vs. the primary film area under the condition that both of the foregoing particles are distributed on primary film 91 of PDP 1. FIG. 9 shows the variation in the Vscn lighting voltage in the case of varying the cover ratio with both of particles 92 and 93.

As shown in FIG. 8, when a total cover ratio exceeds 8%, a sputtered amount (dug depth) in primary film 91 lowers to not greater than 200 nm. When PDP 1, which has undergone the accelerated life test corresponding to 20,000 hours, is dug its primary film 91 by not greater than 200 nm, this status assures PDP 1 of the service life as long as 100,000 hours. The cover ratio thus preferably exceeds 8%. On the other hand, the cover ratio with aggregated particles 92 is suppressed to as low as 11%, and the cover ratio with particles 93 made of non-organic material is further increased, thereby increasing the total cover ratio. Then the electric charge retention characteristics of primary film 91 is degraded, so that the voltage applied to the sustain electrodes increases sharply. Therefore, the total cover ratio should be set at not greater than 50%, and preferably at not greater than 20%. This cover ratio assures the PDP of the service life as long as 100,000 hours and yet the PDP excellent in the electron emission characteristics as well as in the electric charge retention characteristics is obtainable.

FIG. 9 shows the variation in the Vscn lighting voltage in the case of using aggregated particles 92 for covering primary film 91 up to the cover ratio of 8%, and then using particles 93 made of non-organic material for increasing the cover ratio thereafter. As shown in FIG. 9, the Vscn lighting voltage linearly increases up to the cover ratio of 8%, and the electric charge retention characteristics become degraded; however, the voltage is suppressed under 120V so that the PDP can be actually driven. In the region where the cover ratio exceeds 8%, an increase of the cover ratio with particles 93 made of non-organic material will reduce the influence of aggregated particles 92, so that the electric charge retention characteristics slightly improves, thereby lowering the Vscn lighting voltage. However, as discussed previously, the cover ratio over 50% will degrade the electric charge retention characteristics as a whole (not shown), and the voltage applied to the sustain electrodes sharply increases.

In this embodiment, aggregated particles 92 and non-organic material particles 93 are distributed on the entire surface of primary film 91; however the region in which these particles are distributed can be limited within an area where discharge cells, which actually contribute to discharging, are formed on primary film 91. These particles thus can be selectively applied onto the area where the discharge cells are formed.

As discussed above, PDP 1 of the present invention allows lowering the Vscn lighting voltage, i.e. the electric charge retention characteristics, and shortening the discharge delay, i.e. the electron emission characteristics, and yet, ensuring the service life as long as over 100,000 hours by making primary film 91 resistive to the sputtering, which is a key factor in the service life.

In the description discussed previously, the primary film is chiefly made of MgO; however, the chief material is not necessary MgO because the electron emission characteristics can be masterly controlled by single crystal particles of metal oxide. Other materials such as $Al_2O_3$ excellent in shock proof can be used instead of MgO. In this embodiment, MgO particles are used as single crystal particles; however, other single crystal particles such as crystal particles of metal oxides of Sr, Ca, Ba, or Al excellent in the electron emission characteristics can be used, and a similar advantage to what is discussed previously is obtainable. The material of particles is thus not limited to MgO.

INDUSTRIAL APPLICABILITY

The PDP of the present invention achieves a high definition display with a high brightness, and yet, consumes a lower power as well as prolongs the service life. The PDP is thus useful for a large size display device.

The invention claimed is:

1. A plasma display panel (PDP) comprising:

a front panel including:

a substrate on which display electrodes are formed;

a dielectric layer covering the display electrodes; and a protective layer formed on the dielectric layer; and a rear panel disposed facing the front panel, such that a discharge space is formed between the front panel and the rear panel, the rear panel including address electrodes formed along a direction intersecting the display electrodes and including barrier ribs partitioning the discharge space, wherein the protective layer includes a primary film made of metal oxide and formed on the dielectric layer, wherein the protective layer includes a plurality of first particles and at least one type of a plurality of second particles, which is different from the plurality of first particles, wherein each of the plurality of first particles is in a lump form and comprises a plurality of metal oxide crystal particles piled up to form the lump form, and wherein the plurality of first particles and the plurality of second particles are dispersed on the primary film.

2. The PDP of claim 1, wherein the metal oxide is MgO.

3. The PDP of claim 1, wherein a cover ratio of the plurality of first particles to the primary film ranges from 5% to 11% of an area of the primary film.

4. The PDP of claim 1, wherein a cover ratio of the plurality of first particles and the plurality of second particles to the primary film ranges from 8% to 50% of an area of the primary film.

5. The PDP of claim 1, wherein each of the plurality of second particles is made of a non-organic material.

6. The PDP of claim 5, wherein the non-organic material is light transmissible.

7. The PDP of claim 1, wherein each of the plurality of second particles is not an accumulated particle, but is a primary particle.

8. The PDP of claim 5, wherein each of the plurality of second particles is not an accumulated particle, but is a primary particle.

9. The PDP of claim 6, wherein each of the plurality of second particles is not an accumulated particle, but is a primary particle.

* * * * *